US006354910B1

(12) United States Patent
Adebanjo et al.

(10) Patent No.: US 6,354,910 B1
(45) Date of Patent: Mar. 12, 2002

(54) APPARATUS AND METHOD FOR IN-SITU MEASUREMENT OF POLISHING PAD THICKNESS LOSS

(75) Inventors: Richardson O. Adebanjo; William Graham Easter, both of Orlando, FL (US); Alvaro Maury, Villa des Flores (SG); Frank Miceli; Jose Omar Rodriguez, both of Orlando, FL (US)

(73) Assignee: Agere Systems Guardian Corp., Allentown, PA (US)

( * ) Notice: Subject to any disclaimer, the term of this patent is extended or adjusted under 35 U.S.C. 154(b) by 0 days.

(21) Appl. No.: 09/494,705

(22) Filed: Jan. 31, 2000

(51) Int. Cl.[7] ..... B24B 49/00

(52) U.S. Cl. ..... 451/21; 451/6; 451/9; 451/59; 451/288

(58) Field of Search ..... 451/6, 8, 9, 10, 451/11, 22, 21, 41, 56, 59, 288, 289, 290

(56) References Cited

U.S. PATENT DOCUMENTS 5,216,843 A * 6/1993 Breivogel et al. ..... 451/56 X
5,486,131 A * 1/1996 Cesna et al. ..... 451/56
5,801,066 A * 9/1998 Meikle ..... 451/287 X
5,934,974 A 8/1999 Tzeng
5,951,370 A * 9/1999 Cesna ..... 451/21
6,045,434 A * 4/2000 Fisher, Jr. et al. ..... 451/56 X

* cited by examiner

*Primary Examiner*—Joseph J. Hail, III
*Assistant Examiner*—Anthony Ojini
(74) *Attorney, Agent, or Firm*—Christie, Parker & Hale, LLP

(57) ABSTRACT

A non-destructive method for measuring the thickness loss of a polishing pad due to pad conditioning includes the use of rigid planar members placed on the surfaces of both the conditioned and non-conditioned sections of the polishing pad. Measurements are made using measurement instruments which overhang the depressed conditioned section and measure the height difference between the upper surfaces of the planar members. The measurement instruments may be repositioned and measurements repeated to obtain an average thickness loss.

23 Claims, 3 Drawing Sheets

APPARATUS AND METHOD FOR IN-SITU MEASUREMENT OF POLISHING PAD THICKNESS LOSS

TECHNICAL FIELD

The present invention relates generally to chemical mechanical polishing. More particularly, the present invention relates to an apparatus and method for determining the thickness loss of a polishing pad due to pad conditioning.

BACKGROUND OF THE INVENTION

Chemical mechanical polishing (CMP) is a commonly used operation for polishing substrates in the semiconductor manufacturing industry. CMP may be used to planarize substrates, or to remove a deposited film from a substrate by polishing. A CMP operation may be used multiple times during the sequence of process operations used to form a semiconductor device. CMP is available for polishing any of various films used to form semiconductor devices. Many commercially produced CMP tools are available in the semiconductor manufacturing industry.

The polishing pad is generally considered to be the major component of a CMP tool. The polishing pad is generally rotated while contacting the surface to be polished, thereby polishing the surface. The CMP operation must perform a precise and accurate polishing operation. It can be understood that it is important to maintain the characteristics of the polishing pad in the same condition to ensure repeatability and integrity of the polishing operations. In order to maintain the pad characteristics in the same condition and therefore to keep film removal rates constant, the hard, upper section of the polishing pad which includes the polishing surface, requires periodic dressing with a diamond conditioner in order to maintain the integrity and repeatability of the upper section of the polishing pad, especially the polishing surface. As a result of this necessary conditioning process, however, the pad thickness decreases with a corresponding decrease in planarization ability. In addition to the decrease in planarization ability, a conditioned pad of reduced thickness also effectuates other undesirable process non-uniformities, and adversely affects run-to-run repeatability. When this occurs, the polishing pad must be replaced. There is a need to determine the extent of polishing pad thickness reduction, in order to predict when polishing characteristics may be adversely affected and, therefore, when the polishing pad must be replaced.

The standard approach to determining thickness loss and remaining pad thickness consists of cutting out a radial piece of the pad, peeling off the bottom soft pad and using a micrometer to measure the thickness of the hard upper pad directly. This is a destructive test, however, and once used, renders the pad unusable. This is the case even if the measured thickness indicates that the condition of the pad would be acceptable for future use. The standard approach is therefore time consuming and costly. Even if a correlation between [# of conditioning operations] and [pad thickness loss] is established to predict when to replace the polishing pad, the actual thickness loss can vary from pad to pad, in practice.

It can therefore be seen that a method and apparatus for measuring pad thickness, which is non-destructive, is needed in the art. To overcome the shortcomings of the conventional approach to determining polishing pad thickness, the present invention provides an apparatus and method for measuring polishing pad thickness loss, which is non-destructive and, furthermore, does not require the polishing pad to be removed from the polishing tool.

SUMMARY OF THE INVENTION

To achieve these and other objects, and in view of the its purposes, the present invention is directed to a method and apparatus for performing an in-situ measurement of polishing pad thickness loss. Specifically, the present invention provides a rigid first planar member which is placed over a non-conditioned portion of the polishing pad, and a rigid second planar member which is placed over a depressed, conditioned portion of the polishing pad. The present invention further provides a movable upper member positioned over the top of the first planar member, and which includes an overhang portion which overhangs an upper surface of the second planar member. The upper member includes at least one measurement instrument such as a thickness gauge, which measures a vertical distance between respective upper surfaces of the first and second planar members. The vertical distance, or height difference, is due to thickness loss caused by the conditioning process on the conditioned portion of the polishing pad. The upper member may be repositioned and further measurements taken, in order to calculate an average polishing pad thickness loss.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
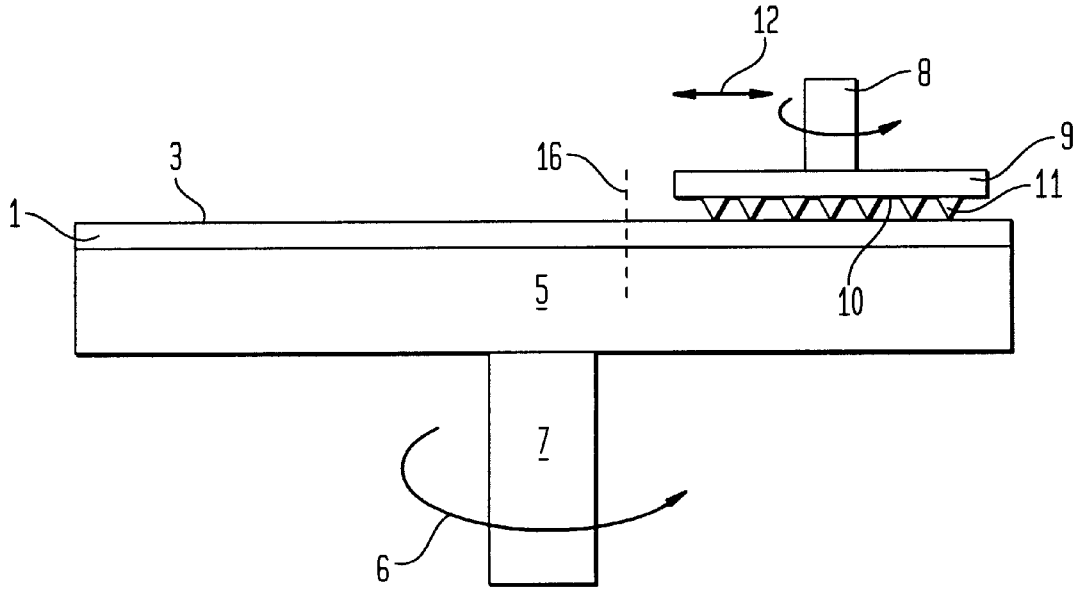
FIG. 1 is a side view of a polishing pad and a conditioning unit.

The present invention takes advantage of the step which is produced upon the polishing pad surface between the region which is conditioned and the region which is non-conditioned. FIG. 1 is a side view of part of a chemical mechanical polishing tool. Polishing pad 1 includes top surface 3 and is secured over platen 5 which is, in turn, connected to shaft 7. Shaft 7 rotates thereby rotating platen 5 and polishing pad 1. In the conventional embodiment, shaft 7 rotates in a counter-clockwise direction as indicated by arrow 6. In other embodiments, shaft 7 may rotated in a clockwise direction. Conditioning unit 9 is used to condition polishing pad surface 3. As discussed above, polishing pad 1 requires conditioning so that the characteristics of polishing pad surface 3 remain constant in time.

Conditioning unit 9 generally conditions pad surface 3 by rotating about axis 8 and has an aggressive and abrasive surface 10 which may include diamonds 11 in the preferred embodiment. A downward force is applied in the direction perpendicular to the pad surface 3, which maintains conditioning unit 9 in contact with polishing pad 1, thereby conditioning surface 3 of polishing pad 1. The aggressive conditioning action of conditioning unit 9 upon polishing pad surface 3, removes some of the material of polishing pad 1 which decreases the thickness of polishing pad 1. It can be seen that, if polishing pad 1 rotates about the central axis of shaft 7, the peripheral section of polishing pad 3 will be conditioned, while the central section of polishing pad 1 will not be conditioned. Conditioning unit 9 may travel radially inward and outward along direction 12 thereby increasing the area which is conditioned. The conditioning procedure is set up, however, to ensure that the conditioning unit 9 does not travel radially inward past a predetermined point 16. It will be shown in FIG. 2 that this effect results in the formation of a permanently non-conditioned region which forms a mesa with respect to the depressed conditioned region of the polishing pad.

Figure 2:
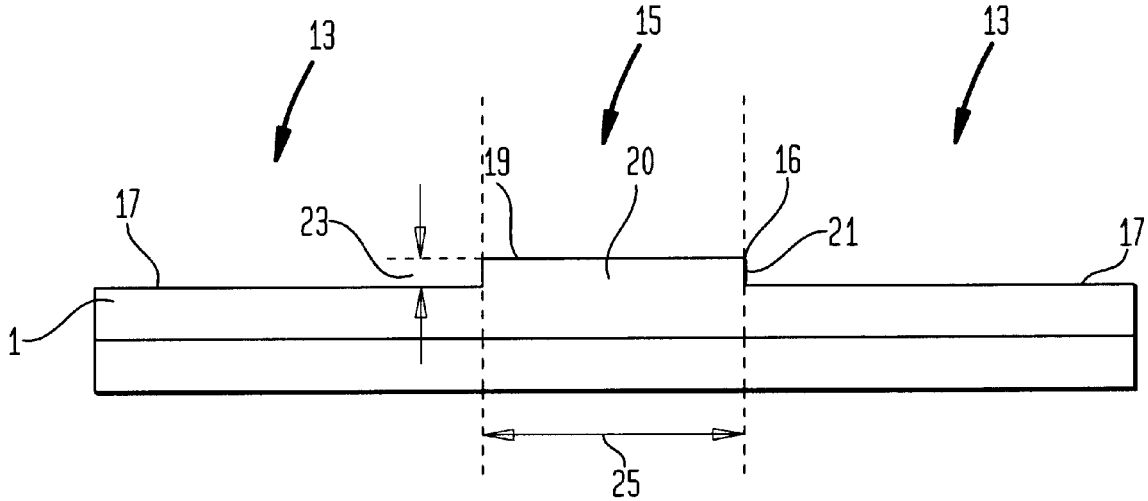
FIG. 2 is a cross-sectional view of a polishing pad including a central, non-conditioned region which forms a mesa.

Now turning to FIG. 2, a cross-sectional view of a conditioned polishing pad is shown. Polishing pad 1 includes a central non-conditioned region 15 which includes non-conditioned surface 19, and conditioned region 13 with conditioned surface 17. Predetermined point 16 which represents the inward extent of travel of conditioning unit 9 (as shown in FIG. 1) along the radial direction, divides conditioned region 13 and non-conditioned region 15. According to the exemplary embodiment, polishing pad 1 is generally circular and non-conditioned region 15 may be represented by substantially circular mesa 20 which is positioned centrally on polishing pad 1. Conditioned region 13 extends peripherally around mesa 20.

Conditioned surface 17 of conditioned region 13 is depressed relative to original pad surface 3, and relative to non-conditioned surface 19 of non-conditioned region 15. Mesa 20 includes step 21 which extends circumferentially around mesa 20 in the exemplary embodiment, in which mesa 20 is substantially circular. Step 21 includes step height 23 and mesa 20 includes width 25. In an exemplary embodiment, mesa 20 may include a width 25 ranging from 5 to 7 centimeters. It can be understood that diameter 25 of mesa 20 varies depending on the extent of radially inward travel of conditioning unit 9. Step height 23 may be alternatively expressed as thickness loss of polishing pad 1 due to conditioning, since non-conditioned surface 19 is essentially of the same height as original pad surface 3 (as shown in FIG. 1) of polishing pad 1. The present invention takes advantage of the height difference, step height 23, between upper surface 19 of non-conditioned region 15 and upper surface 17 of conditioned region 13. Since it is generally known in the art, or can easily be determined, a predetermined step height 23 of polishing pad 1 can generally be associated with a thickness loss, at which point the polishing characteristics deteriorate and the pad must be removed and replaced.

Figure 3A:
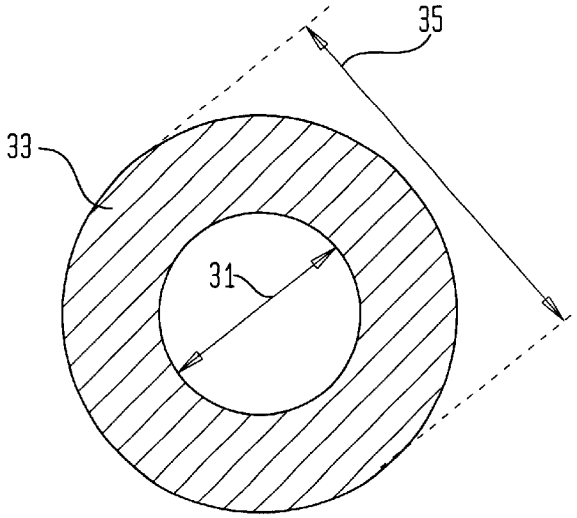
FIG. 3A is a top view of an exemplary embodiment of a second planar member of the measurement apparatus.
Figure 3B:
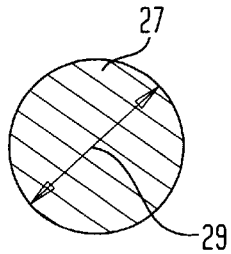
FIG. 3B is a top view of an exemplary embodiment of a first planar member of the measurement apparatus.

FIGS. 3A and 3B show a top view of an exemplary embodiment of second and first rigid planar members, respectively, of the present invention. The rigid planar members shown may be used in conjunction with the exemplary embodiment of the polishing pad shown in FIG. 2. Rigid second planar member 33 shown in FIG. 3A, includes outer diameter 35 and inner diameter 31. Inner diameter 31 is chosen to fit around the non-conditioned mesa area (20, shown in FIG. 2) as shown in the exemplary embodiment. Rigid first planar member 27, as shown in FIG. 3B, includes diameter 29. Rigid first planar member 27 is placed over the non-conditioned surface of the non-conditioned region of the polishing pad. In an exemplary embodiment, rigid first planar member 27 may be shaped generally to conform to the shape of the non-conditioned region of the pad. It is not critical, however, that diameter 29 corresponds to a diameter of the non-conditioned region of the polishing pad. In various embodiments, diameter 29 may be greater or less than the diameter of the non-conditioned portion of the polishing pad, or rigid first planar member 27 may take on a different shape than the non-conditioned surface over which it will be placed. The same is true for the configuration of second rigid planar member 33 as shown in FIG. 3A. So long as inner diameter 31 of second rigid planar member 33 affords second rigid planar member 33 the ability to fit around the conditioned region and to be seated evenly over the conditioned surface, inner diameter 31 may take on various dimensions. Likewise, outer diameter 35 of second rigid planar member 33 may be any suitable dimension. In a preferred embodiment, each of rigid first planar member 27 and rigid second planar member 33 may be formed of a metal such as stainless steel. In alternative embodiments, each of the rigid planar members may be formed of any material which maintains its rigidity and is non-deformable.

Figure 4:
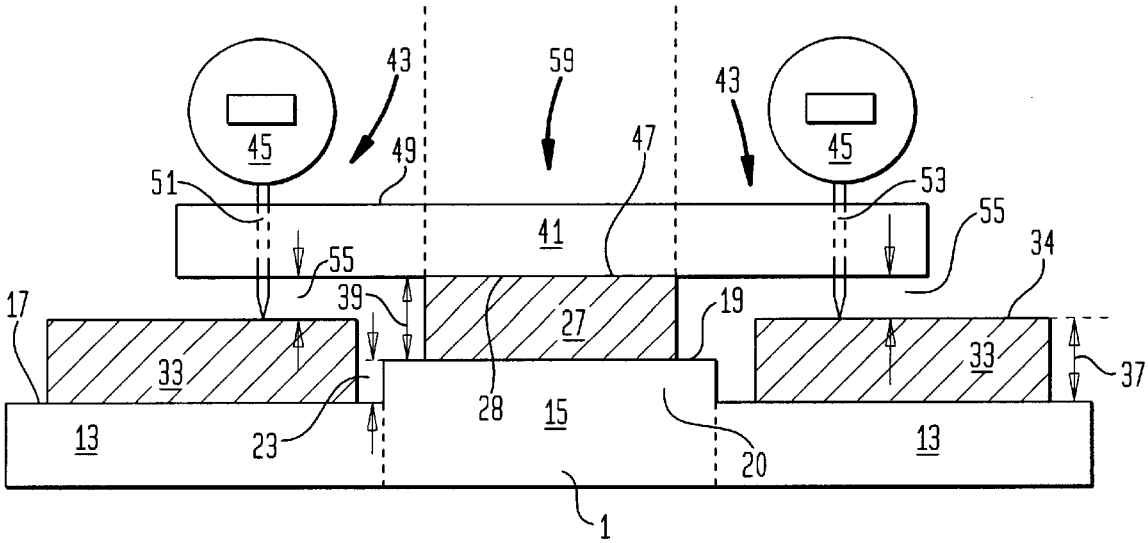
FIG. 4 is a cross-sectional view of an exemplary embodiment of the measurement apparatus of the present invention which is placed over a conditioned polishing pad.

FIG. 4 is a cross-sectional view of the measurement apparatus of the present invention placed over a conditioned polishing pad. Polishing pad 1 includes central non-conditioned region 15 and peripherally extending conditioned region 13. In the exemplary embodiment, non-conditioned region 15 may be a centrally disposed mesa 20 of a generally round polishing pad 1. As such, conditioned region 13 extends peripherally about non-conditioned region 15. It can be seen that non-conditioned surface 19 reaches a greater height than conditioned surface 17. Step height 23 represents the vertical distance between conditioned surface 17 and non-conditioned surface 19, and is equal to the thickness loss of the conditioned portion 13 of polishing pad 1. Rigid first planar member 27 is placed over planar non-conditioned surface 19, and rigid second planar member 33 is placed over planar conditioned surface 17. It can be seen that if height 39 of rigid first planar member 27 is equal to height 37 of rigid second planar member 33, then vertical distance 55 between first upper surface 28 and second upper surface 34 is equal to step height 23 between conditioned surface 17 and non-conditioned surface 19. In alternative embodiments, thicknesses 37 and 39 may differ and the difference will be taken into account when calculating the actual thickness loss, step height 23, from the measured vertical distance.

Above first upper surface 28 of rigid first planar member 27 is placed rigid upper member 41. It can be seen that rigid upper member 41 includes lower surface 47, a portion of which forms a contiguous boundary with first upper surface 28. In an exemplary embodiment, rigid upper member 41 may be a bar. Rigid upper member 41 may be formed of a metal, such as stainless steel. In alternative embodiments, rigid upper member 41 may be formed of other materials, chosen to ensure the rigidity and non-deformation of rigid upper member 41. Rigid upper member 41 includes a contiguous region 59, and an overhang portion 43. As shown in the exemplary embodiment in which rigid upper member 41 is a bar, overhang portion 43 is formed of a pair of oppositely extending ends which extend radially outward from a center of rigid first planar member 27. Any suitable configuration of rigid upper member 41 may be used, provided that overhang portion 43 overhangs at least portion of rigid second planar member 33. In an exemplary embodiment, rigid upper member 41 may be generally circular, wherein overhang portion 43 extends peripherally around centrally disposed rigid first planar member 27.

Rigid upper member 41 may be affixed to rigid first planar member 27, or it may simply be placed on top of rigid first planar member 27, so that lower surface 47 of rigid upper member 41 contacts upper surface 28 of first planar member in contiguous region 59. This accommodates easy repositioning of rigid upper member 41 with respect to rigid first planar member 27, and therefore rigid second planar member 33. In an exemplary embodiment, rigid upper member 41 will easily slide over upper surface 28 for repositioning.

Rigid upper member 41 includes at least one measurement instrument 45 disposed within overhang portion 43. In the exemplary embodiment, two measurement instruments 45 are shown. One measurement instrument 45 may be disposed at a first location 51, while a second measurement instrument 45 may be disposed at a second location 53. Measurement instrument 45 may be a thickness gauge, or any suitable measurement instrument which can measure the vertical distance 55 between lower surface 47 of rigid upper member 41, and second upper surface 34 of rigid second planar member 33. It should be understood that various alternative configurations are contemplated. For example, overhang portion 43 may be of any suitable configuration, provided that overhang portion 43 overhangs at least a portion of rigid second planar member 33 so as to enable measurement instrument 45 to measure vertical distance 55. In an exemplary embodiment, measurement instrument 45 may be a thickness gauge, but any measurement instrument capable of measuring distance 55 between second upper surface 34 of second rigid planar member 33, and first upper surface 28 of rigid first planar member 27, may be used.

In an exemplary embodiment, pad thickness loss, as indicated by step height 23, may be calculated by averaging the height differences measured at location 51 and location 53. In another exemplary embodiment, a number of height measurements may be made. After height measurements are made at locations 51 and 53 as shown in FIG. 4, rigid upper member 41 may be repositioned. In an exemplary embodiment, rigid upper member 41 may be rotated with respect to polishing pad 1. First upper surface 28 and lower surface 47 of rigid upper member 41 are chosen to enable rigid upper member 41 to slide easily over rigid first planar member 27. After rigid upper member 41 is repositioned, for example by sliding, measurements are made by the measurement instruments at their respective new locations. These measurements may be averaged, and rigid upper member 41 may again be repositioned and additional measurements taken. This may be continued a number of times to provide good statistical averaging.

Figure 5:
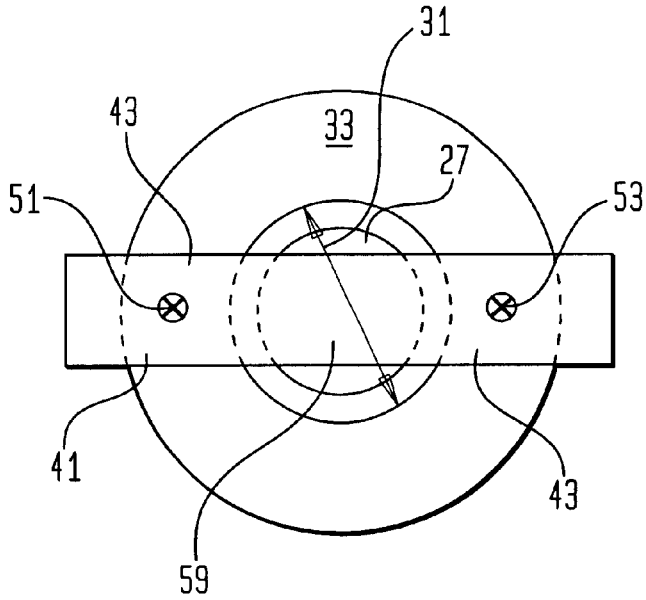
FIG. 5 is a top view of an exemplary embodiment of the measurement apparatus of the present invention.

FIG. 5 is a top view of the apparatus shown in FIG. 4. Inner diameter 31 of rigid second planar member 33 extends around rigid first planar member 27. Rigid upper member 41 is a bar having an overhang portion consisting of a pair of opposed overhang regions 43 which overhang rigid second planar member 33. Measurement instruments (not shown) may be located at opposed locations 51 and 53. Rigid upper member 41 also includes a contiguous region 59 in which the lower surface (surface 47 as shown in FIG. 4) of rigid upper member 41 contacts the upper surface (first upper surface 28 shown in FIG. 4) of rigid first planar member 27.

Figure 6:
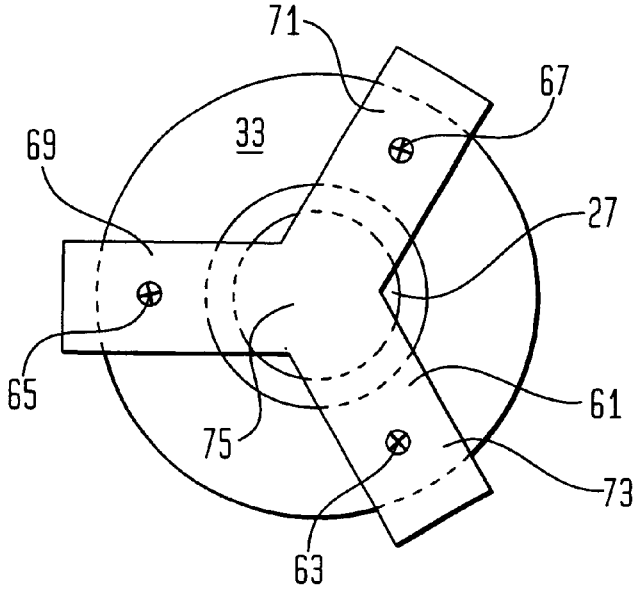
FIG. 6 is a top view of another exemplary embodiment of the measurement apparatus of the present invention.

FIG. 6 shows another exemplary embodiment of the measurement apparatus of the present invention. In FIG. 6, where similarly numbered features are as described in conjunction with FIGS. 4 and 5, rigid upper member 61 consists of an overhang portion including three distinct overhang regions 69, 71, and 73. Rigid upper member 61 includes a central contiguous region 75 which contacts the upper surface (first upper surface 28 shown in FIG. 4) of rigid first planar member 27. The three discrete overhang regions 69, 71, and 73 each include a corresponding position—65, 67, and 63 at which a measurement instrument (not shown) may be included. In the exemplary embodiment shown in FIG. 6, three vertical distance measurements (as in FIG. 4) may be made, and averaged to provide an average vertical distance, from which the average pad thickness loss may be calculated. In an exemplary embodiment in which the thickness of rigid first planar member 27 equals the thickness of rigid second planar member 33, the average vertical distance is equal to the average pad thickness loss. In an exemplary embodiment, the three discrete overhang regions 69, 71 and 73 may be spaced approximately 120° apart. Upper rigid member 61 may be rotated with respect to the polishing pad multiple times and measurements may be taken each time.

The present invention is not intended to be limited to the configurations of the various members of the measurement apparatus shown. Rather, various other configurations are contemplated. The rigid planar members need not conform to the shapes of the conditioned and non-conditioned regions so long as they may each be positioned evenly over the conditioned and non-conditioned surfaces to allow for the rigid upper member to include an overhang portion on which a measurement instrument may be positioned to read the distance between the upper surfaces of the rigid planar members.

The apparatus and method of the present invention may be used by placing the apparatus over the polishing pad while the polishing pad is still within the CMP tool and adapted for continued use. The method and apparatus of the present invention may be used after some degree of conditioning has been done on the polishing pad. If the thickness loss of the pad indicates that the pad must be replaced in order to ensure process repeatability and integrity of polishing qualities, then the polishing pad is removed and replaced. If a thickness loss indicates that the polishing pad is suitable for continued use, the apparatus is simply removed and the polishing pad may be used for continued polishing operations. The polishing pad is conditioned on a regular basis as determined by the number of polishing operations carried out by the polishing pad, and also the nature of the polishing process performed. After the periodic reconditioning process of the polishing pad, the apparatus of the present invention may be reintroduced to the polishing pad, and the method repeated.

It should be emphasized that the present invention is not intended to be limited to the embodiments shown. In other exemplary embodiments, the rigid first planar member placed on the non-conditioned portion of the pad, and the rigid second planar member placed on the depressed conditioned part of the polishing pad, may not be of equal thickness. Moreover, the overhang portion of the rigid upper member may include a lower surface which is not coplanar with the lower portion of the rigid upper member in the contiguous region. Allowances may be made for these height differences, and the height difference of the conditioned, and non-conditioned region of the polishing pad may be calculated even though the absolute distance measurement made between the lower surface of the rigid upper member and the second upper surface of the rigid second planar member, may not be equivalent to the height difference of the different sections of the pad. The thickness loss of the conditioned position of the polishing pad may be calculated from the measured thickness.

The proceeding description merely illustrates the principles of the invention. It will thus be appreciated that those skilled in the art will be able to devise various arrangements which, although not explicitly described or shown herein, embody the principles of the invention and are included within its scope and spirit. Furthermore, all examples and conditional language recited herein are principally intended to be expressly for pedagogical purposes to aid the invention and concept contributed by the inventors to furthering the art, and are to be construed as being without limitation to such specifically recited examples and conditions.

Moreover, all statements herein reciting principles, aspects and embodiments of the invention, as well as specific examples thereof, are intended to encompass both structure and functionally equivalence thereof. Additionally, it is intended that such equivalents include both currently known, as well as equivalents developed in the future, i.e., any elements developed that perform the same functions regardless of structure. As such, the invention is not intended to be limited to the details shown. Rather, various modifications and additions may be made to details within the scope and range of equivalence of the claims and without departing from the invention. Accordingly, it is intended by the appended claims to cover all such modifications and changes as far within the true spirit and scope of the invention.

What is claimed:

1. A measuring device for a chemical mechanical polishing apparatus, comprising:

a rigid first planar member having a first upper surface and adapted to be placed on a non-conditioned region of a polishing pad;

a rigid second planar member having a second upper surface and adapted to be placed on a depressed conditioned region of said polishing pad;

a rigid upper member adapted to be placed on said first planar member such that an overhang portion of said rigid upper member overhangs said conditioned region; and at least one measurement instrument disposed along said overhang portion of said upper member, each measurement instrument capable of measuring a vertical distance between said first upper surface and said second upper surface.

2. The measuring device as in claim 1, wherein said measurement instrument of said at least one measurement instrument comprises a thickness gauge.

3. The measuring device as in claim 1, wherein said non-conditioned region comprises a generally circular central region, and said conditioned region extends peripherally around said non-conditioned region.

4. The measuring device as in claim 3, wherein said overhang portion includes a duality of separate overhang sections on opposed sides of said non-conditioned region, each overhang section having a measurement instrument of said at least one measurement instrument, disposed thereon.

5. The measuring device as in claim 3, wherein said overhang portion extends circumferentially around said non-conditioned region.

6. The measuring device as in claim 3, wherein said overhang portion includes three separate overhang sections, each including a measurement instrument of said at least one measurement instrument disposed thereon, and wherein said three overhang sections each extend radially outward from said central region.

7. The measuring device as in claim 1, wherein said upper member is capable of sliding over said first upper surface.

8. The measuring device as in claim 3, wherein said upper member comprises a bar and wherein said overhang portion comprises opposed ends of said bar, each of which overhang said conditioned region, and said at least one measurement instrument comprises two measurement instruments, one on each of said opposed ends, and said upper member is rotatable about said non-conditioned region.

9. The measuring device as in claim 1, wherein said first planar member and said second planar member are each formed of metal.

10. The measuring device as in claim 9, wherein said metal comprises stainless steel.

11. The measuring device as in claim 1, wherein said first planar member is shaped generally to conform to said non-conditioned region and said second planar member is shaped generally to conform to said conditioned region.

12. The measuring device as in claim 1, wherein said first upper surface is contiguous with a portion of a lower surface of said upper member.

13. The measuring device as in claim 1, wherein said upper member is comprised of metal.

14. The measuring device as in claim 1, wherein said first planar member has a first thickness and said second planar member has said first thickness, and said vertical distance therefore equals a height difference between said conditioned region and said non-conditioned region.

15. A measuring device for a chemical mechanical polishing apparatus, comprising:

a rigid first planar member adapted to be placed on a generally circular, central non-conditioned region of a polishing pad, said first planar member having a first thickness and a first upper surface;

a rigid second planar member adapted to be placed on a depressed conditioned region of said polishing pad and extending peripherally around said non-conditioned region, said second planar member having said first thickness and a second upper surface;

a rigid upper member adapted to be placed on said first planar member such that a pair of opposed overhang portions of said rigid upper member each overhang said conditioned region and a lower surface of said rigid upper member is contiguous with said first upper surface, said upper member being rotatable about said central non-conditioned region; and at least one measurement instrument disposed along each of said overhang portions of said upper member, each measurement instrument capable of measuring a vertical distance between said first upper surface and said second upper surface.

16. A method for measuring polishing pad wear in a chemical mechanical polishing apparatus, comprising the steps of:

a) placing a rigid first planar member over a non-conditioned region of a polishing pad, said first planar member having a first thickness and a first upper surface;

b) placing a rigid second planar member over a depressed conditioned region of said polishing pad, said second planar member having a second thickness and a second upper surface;

c) placing a rigid upper member on said first planar member, said upper member including a lower surface being contiguous with said first upper surface and an overhang portion overhanging said second planar member, said overhang portion including a measurement instrument disposed thereon; and d) measuring a vertical distance between said first upper surface and said second upper surface at a first location using said measurement instrument.

17. The method as in claim 16, further comprising steps:

e) repositioning said upper member on said first planar member; and f) measuring a further vertical distance between said first upper surface and said second upper surface at a second location.

18. The method as in claim 16, further comprising steps:

e) repositioning said upper member on said first planar member a plurality of times, each time measuring an associated vertical distance between said first upper surface and said second upper surface at a respective further location; and f) determining an average vertical distance from said plurality of measured vertical distances.

19. The method as in claim 17, wherein said non-conditioned region is centrally located on said polishing pad and said conditioned region extends peripherally about said non-conditioned region, said upper member comprises a bar, said overhang portion includes a duality of opposed overhang sections, and in which step e) includes rotating said upper member around said non-conditioned region.

20. The method as in claim 16, further comprising the step e) of replacing said polishing pad whereupon said measured vertical distance exceeds a prescribed vertical distance value.

21. The method as in claim 16, further comprising the steps of:

e) further conditioning said conditioned region of said polishing pad;

f) repeating said steps a) through d); and g) if said vertical distance exceeds a prescribed value, replacing said polishing pad.

22. The method as in claim 16, in which said step c) includes a further measurement instrument disposed on said overhang portion and said step d) includes further measuring a further vertical distance between said first upper surface and said second upper surface at a second location using said further measurement instrument.

23. The method as in claim 22, in which said step d) includes calculating an average vertical distance from said vertical distance and said further vertical distance and further comprising steps:

e) repositioning said upper member on said first planar member a plurality of times, each time calculating an associated average vertical distance by measuring at respective further first and second locations, and f) determining an overall average vertical distance from said plurality of average vertical distances.

* * * * *